US005867191A

United States Patent [19]

Luque et al.

[11] Patent Number: 5,867,191

[45] **Date of Patent: *Feb. 2, 1999**

[54] TONER PROJECTION PRINTER WITH MEANS TO REDUCE TONER SPREADING

[75] Inventors: Phillip R. Luque; James G. Bearss, both of Boise, Id.

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 498,808

[22] Filed: Jul. 6, 1995

[51] Int. Cl.[6] ..... G03G 15/06

[52] U.S. Cl. ..... 347/55

[58] Field of Search ..... 347/54, 55, 112, 347/141, 151

[56] References Cited

U.S. PATENT DOCUMENTS

| | | | |
|---|---|---|---|
| 5,036,341 | 7/1991 | Larson | 346/154 |
| 5,121,144 | 6/1992 | Larson et al. | 346/154 |
| 5,170,185 | 12/1992 | Takemura | 346/140 R |
| 5,606,402 | 2/1997 | Fuyito et al. | 389/222 |

FOREIGN PATENT DOCUMENTS

| | | |
|---|---|---|
| WO90/14959 | 12/1990 | WIPO . |
| WO90/14960 | 12/1990 | WIPO . |

*Primary Examiner*—Daniel P. Malley
*Assistant Examiner*—Christopher E. Mahoney

[57] ABSTRACT

A toner projection printer is provided with a developer surface which manifests a developer bias, and includes a cloud of entrained toner particles. A platen structure is positioned opposed to the developer surface and manifests a platen voltage that is attractive to the toner particles. An address plate is positioned between the developer surface and the platen structure. The address plate includes a determined thickness insulator with through pixel apertures. Each pixel aperture has at least first and second conductors that are electrically insulated from each other by the insulator, and a screen electrode for distorting the electric field between the address plate and the platen structure in a manner to reduce toner spreading. A first drive circuit is coupled to the first conductor for controllably applying a row drive voltage which is either a reference potential that exerts a repulsive force on the toner particles or a high voltage which is attractive to the toner particles. A second drive circuit is coupled to the second conductor for controllably applying a column voltage drive that is either a reference voltage (repulsive to the toner particles) or a high voltage (attractive to the toner particles). Both the column and row drive voltages are set at levels so that only when both are high can toner particles pass through the pixel aperture, be drawn towards the conductive platen and come under influence of the platen voltage. Control circuitry operates the first and second driver circuits to enable deposition of row and column dots of toner on a media sheet positioned on the platen, under influence of the platen potential. An improved platen structure is also shown which further reduces toner spreading.

10 Claims, 7 Drawing Sheets

TONER PROJECTION PRINTER WITH MEANS TO REDUCE TONER SPREADING

FIELD OF THE INVENTION

This invention relates to electrostatic printing devices and, more particularly, to a toner projection printer employing electrostatic toner deposition means for reducing toner spreading.

BACKGROUND OF THE INVENTION

The most widely used electrophotographic print apparatus employs a movable photoconductor which is selectively exposed by a source of optical energy. While such electrophotographic printers have been widely accepted and produce excellent print quality at reasonable cost, continued efforts are being directed to increase their performance and further reduce their cost. However, photoconductor-based printers will continue to exhibit certain problems which inherently arise from the use of a photoconductor. Among those are the cost of the photoconductor, photoconductor wear; and photoconductor sensitivity to light requiring continual shielding. Further, when an image is fully developed on the photoconductor, a transfer action must occur to enable removal of the toner to a media sheet.

Recently, a new class of electrostatic printers has been developed which requires no photoconductor and avoids many problems inherent with the use of the photoconductor. That class of printers comprise "toner projection printers" which include a system of electrodes for controlling direct deposition of charged toner particles on a media sheet without an intervening photoreceptor or photoconductive device. Typically each electrode includes a conductive electrode ring surrounding a hole in an insulating substrate. On one side of the substrate is a developer module which includes a developer roll and a supply of charged dry toner particles.

For a system employing negatively charged toner particles, when an electrode ring is driven positive with respect to the developer roll, the toner particles are attracted to the electrode ring and some pass through the hole. On the opposite side of the insulating substrate is a media sheet which rests on a conductive platen. The platen is biased to a voltage that is more positive than the electrode ring so that toner particles are attracted to the paper/platen combination. The toner particles that pass through the hole all exhibit a like charge. Thus, those particles repulsively interact during their travel to the media sheet and the result is some toner "spreading" at the point of deposition. Also, previously deposited toner exhibits a like charge which further adds to toner spreading. As a result, the edge definition of the deposited toner dots becomes less sharp.

Toner that is attracted to the electrode ring but does not path through the aperture, collects around the aperture and must be removed periodically. This is accomplished by reversing the potential between the electrode ring and the developer roll to pull such toner deposits away from the insulating substrate and electrode ring and back to the developer roll.

U.S. Pat. No. 5,036,341 to Larson et al. describes a toner projection printer wherein the print control matrix comprises two layers of parallel wires in each of two layers. The two layers are orthogonal and are disposed parallel to the plane of a media sheet upon which the toner is to be developed. The wires in each layer are arranged in the form of a bar pattern and each separate wire is connected to a drive circuit. A toner dot is printed when two adjacent wires in each layer are driven positively (assuming a negatively charged toner). Toner is then drawn to a hole at the intersection of the two pairs of positively driven wires, passes therebetween and is deposited upon a media sheet.

The Larson system exhibits a number of disadvantages. The array of wires can only be supported by a frame structure around the edge of the print array. Very little sag in the wires can be tolerated due to the tight spacing control which must be maintained between the print wire array and the paper. The array of wires is fragile and each layer must be perfectly insulated from the other, which is difficult considering the number of cross-over points. There also may be some leakage of toner through adjacent holes between wire pairs. Lastly, the holes formed by the intersecting wires are square and may not provide optimum shaped dots for best print resolution.

U.S. Pat. No. 5,121,144 to Larson describes a multiplexing system for a toner projection printer. In lieu of employing a continuous conductive platen behind the media sheet upon which toner is to be deposited, the Larson '144 patent utilizes an insulating platen which includes many conducting wires that are inlaid across the direction of movement of the media sheet. Electrodes which control toner deposition are positioned on an insulating substrate above the media sheet and are connected together in a number of sets, so that only one electrode in each set is directly over a given wire in the conductive platen. Only one platen wire at a time is driven to a high positive voltage (for a negatively charged toner). When an electrode set is also driven positive, the single electrode which resides over the active wire in the platen causes a deposition of toner on the media sheet.

The structure shown in the '144 Larson patent also exhibits a number of disadvantages. The platen structure is complex and includes many precision-inlaid conductors. The insulation between these conductors must withstand a high voltage (e.g., approximately 1000 volts) and must maintain insulating properties, even though it is subject to wear as media sheets pass over it. The drive circuits for the platen wires must also be capable of driving a high voltage—which is a much higher voltage than that required to drive the print electrodes directly (approximately 100 volts). The higher voltage drive circuits are correspondingly more expensive. Finally, the platen with its inlaid wires must be precisely aligned with the printing electrode array to achieve acceptable print quality.

PCT published Application WO 90/14960 to Larson describes an improvement to the electrode structure shown in the Larson '341 patent referred to above. In the PCT published Application, Larson employs isolation electrodes to reduce cross coupling or cross talk between adjacent mesh electrodes. In PCT published Application WO 90/14959 to Larson, a procedure is described for removing deposited toner from an electrode matrix which employs a reverse voltage application during periods between address times. However, when toner particles adhere to the electrode rings, they tend to lose their charge by conduction through the electrode rings. Thus, application of a reverse voltage to remove such particles is ineffective due to their loss of charge.

As can be seen from the above, while toner projection printers eliminate the need for a photoconductor belt or surface, cost and performance improvements are required before the benefits to be obtained by the elimination of the photoconductor component will be realized.

Accordingly, it is an object of this invention to provide an improved toner projection printer which exhibits less toner spreading than heretofore.

SUMMARY OF THE INVENTION

A toner projection printer is provided with a developer surface which manifests a developer bias, and includes a cloud of entrained toner particles. A platen structure is positioned opposed to the developer surface and manifests a platen voltage that is attractive to the toner particles. An address plate is positioned between the developer surface and the platen structure. The address plate includes a determined thickness insulator with through pixel apertures. Each pixel aperture has at least row and column conductors that are electrically insulated from each other by the insulator, and a screen electrode for distorting the electric field between the address plate and the platen structure in a manner to reduce toner spreading. A first drive circuit is coupled to the row conductor for controllably applying a row drive voltage which is either a reference potential that exerts a repulsive force on the toner particles or a high voltage which is attractive to the toner particles. A second drive circuit is coupled to the column conductor for controllably applying a column voltage drive that is either a reference voltage (repulsive to the toner particles) or a high voltage (attractive to the toner particles). Both the column and row drive voltages are set at levels so that only when both are high can toner particles pass through the pixel aperture, be drawn towards the platen structure and come under influence of the platen voltage. Control circuitry operates the first and second drive circuits to enable deposition of row and column dots of toner on a media sheet positioned on the platen structure, under influence of the platen potential. An improved platen structure is also shown which further reduces toner spreading.

DETAILED DESCRIPTION OF THE INVENTION

Figure 1:
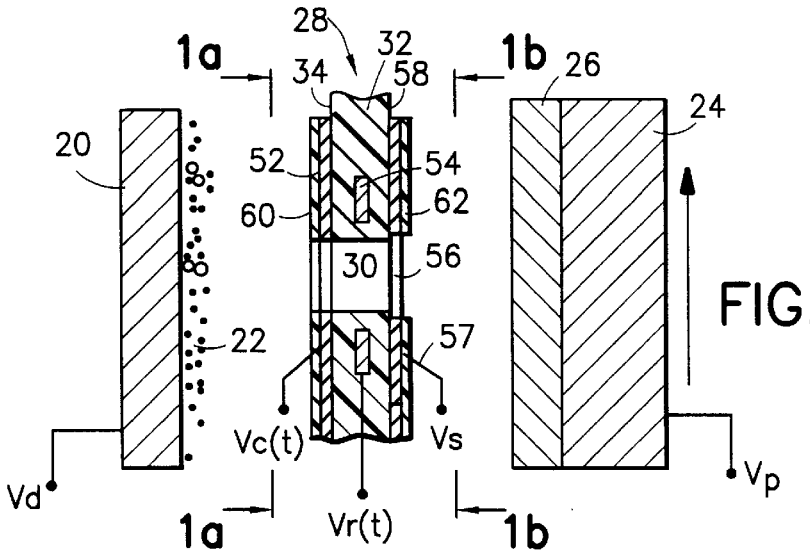
FIG. 1 is a schematic sectional view of a portion of the toner projection printer including the developer surface with an entrained toner cloud, an address plate and a conductive platen with a media sheet positioned thereon.

Referring to FIG. 1, the print portion of the toner projection printer is shown in section. A developer roll surface 20 is preferably comprised of a conductive elastomer and has applied thereto a developer bias Vd. Toner 22 is adherent to developer roll surface 20 by virtue of charge attraction between the toner particles and developer bias Vd. In a preferred embodiment, toner particles 22 are single component dielectric particles that are negatively charged.

In opposition to developer roll surface 20 is a conductive platen 24 which has applied thereto a bias voltage Vp. Voltage Vp is highly positive (e.g., 1000 volts) and creates a high electrostatic field that is attractive to toner particles 22. A media sheet 26 is positioned on conductive platen 24 and is positioned to receive toner dots configured in an image format.

Positioned between developer roll surface 20 and conductive platen 24 is an address plate 28 which, in accordance with appropriate row and column drive potentials, enables toner particles 22 to selectively pass through apertures 30 to come under the influence of the electric field created by voltage Vp applied to conductive platen 24.

Figure 1A:
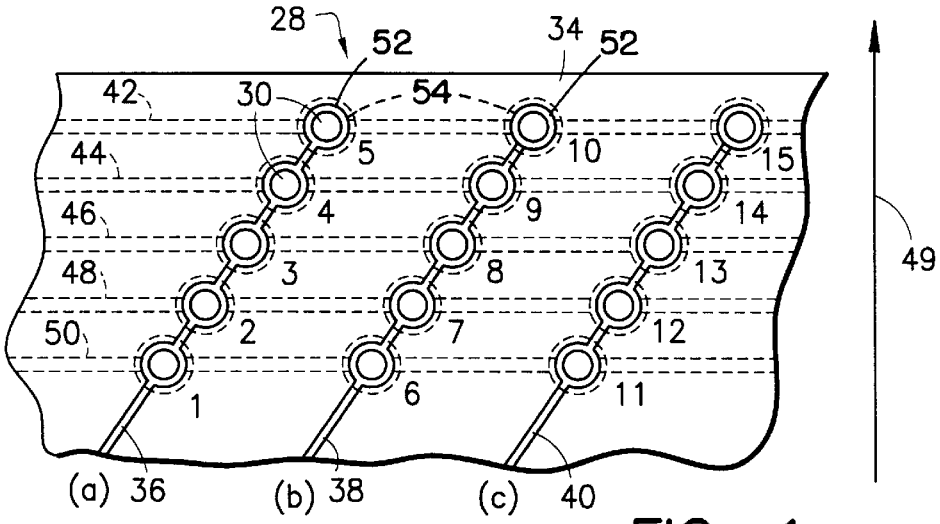
FIG. 1*a* is a plan view of the address plate taken along line 1*a*—1*a* in FIG. 1.

A partial plan view of address plate 28 is shown in FIG. 1*a*, and only a single aperture and associated electrodes are shown in FIG. 1. Aperture plate 28 comprises an insulating sheet 32 having a surface 34 on which a plurality of column traces 36, 38, 40, etc. are positioned. Within insulating sheet 32, a plurality of row traces 42, 44, 46, 48, and 50 are positioned so as to intersect the respective column traces. About each aperture 30, each column trace includes a conductive electrode ring 52 and, in a similar manner, each row trace includes a conductive electrode 54 positioned within insulating sheet 32.

Figure 1B:
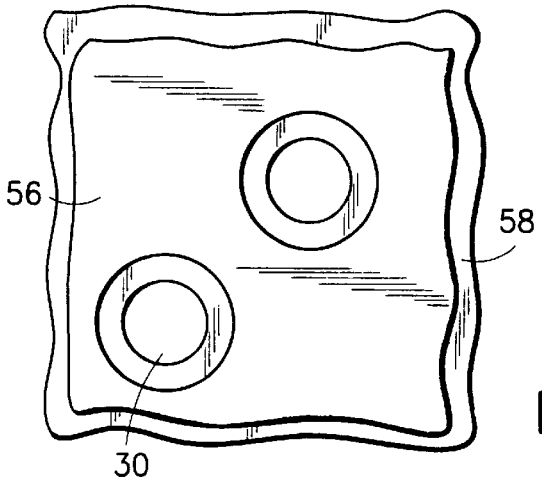
FIG. 1*b* is a plan view of the address plate taken along line 1*b*—1*b* in FIG. 1.

A screen electrode 56 is positioned on surface 58 of address plate 28 and includes an opening at each pixel aperture 30. A plan view of screen electrode 56, taken along line 1*b*—1*b* in FIG. 1*a*, is shown in FIG. 1*b*. A screen voltage Vs is applied to screen electrode 56 via conductor 57 and is less positive than a full select voltage applied to intersecting row and column electrodes.

Insulating layers 60 and 62 cover the respective surfaces of column electrode rings 52 and screen electrode 56. As will become apparent from the description below, insulating layers 60 and 62 prevent toner particles from coming into contact with the conductive surfaces of the column electrode traces, column electrode rings and screen electrode 58. As a result, conductive discharge of toner particle charges is prevented.

Each column trace 36, 38, 40, etc. is connected to a column driver circuit (to be described below) which applies a column drive voltage Vc(t) to each of the connected column traces and connected column electrode rings. In a similar manner, each of row traces 42, 44, 46, 48, 50, etc. is connected to a row driver (to be described below) which selectively applies a row drive voltage Vr(t) thereto. Arrow 49 illustrates the direction of movement of a media sheet beneath address plate 28.

Figure 2:
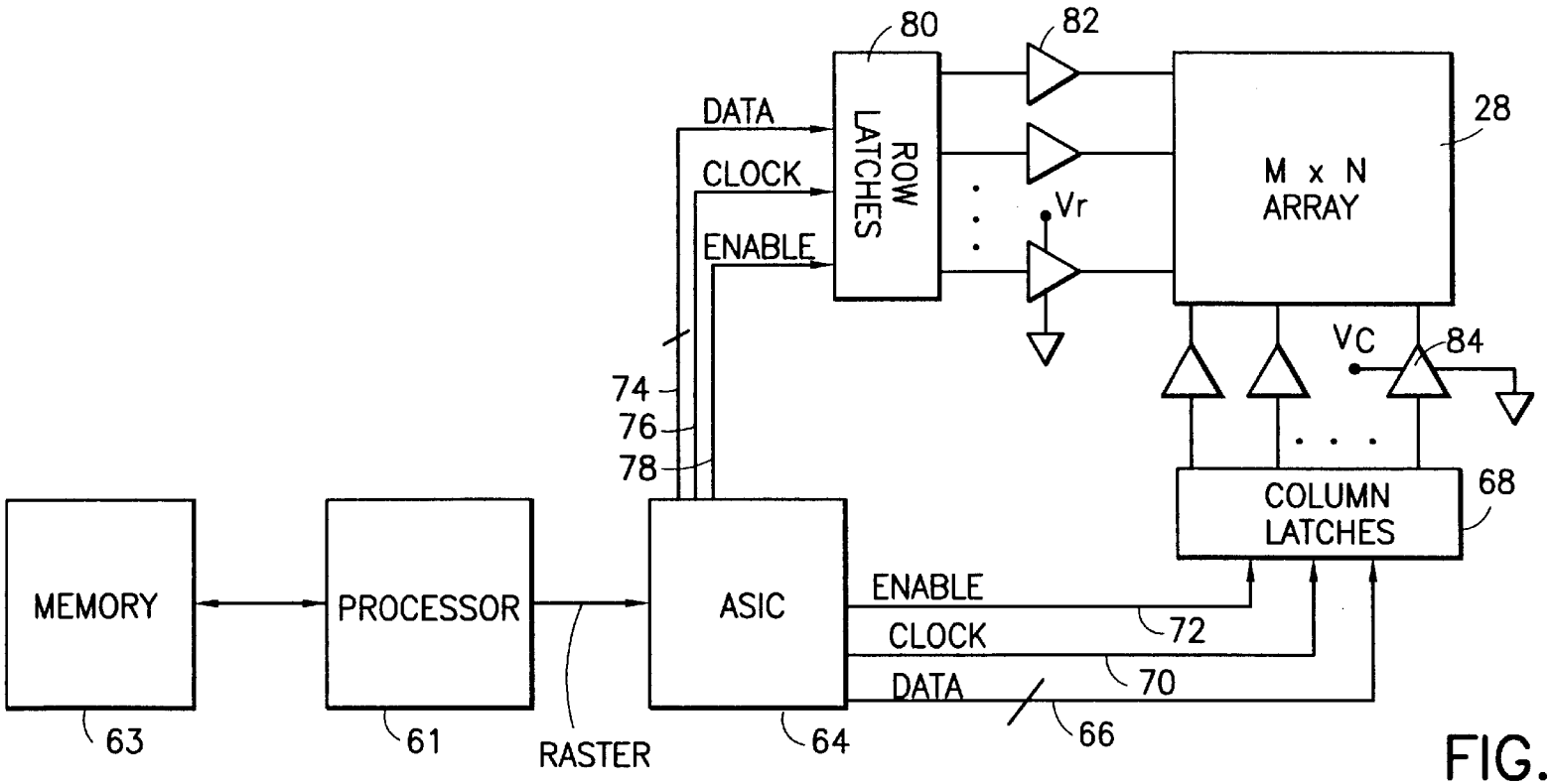
FIG. 2 is a circuit diagram illustrating circuitry for applying row and column drive potentials to the row and column traces on the address plate.

In FIG. 2, circuitry for addressing the array of pixel apertures in address plate 28 is shown. A processor 61 and connected memory 63 combine to provide raster-oriented binary pixel data to an application specific integrated circuit (ASIC) 64. Within ASIC 64, the raster data is organized so that half select signals for the column traces are output on data lines 66 to a plurality of column latches 68. A clock line 70 enables operation of latches 68 in accordance with an enable signal that is impressed by ASIC 64 onto line 72. In similar fashion, ASIC 64 applies data, clock and enable signals via lines 74, 76, 78, respectively to row latches 80 which enable column drive signals to be applied to sequential column traces. The outputs from row latches 80 and column latches 68 are applied to row and column drivers 82, 84, respectively. Each row driver 82 and column driver 84 applies a drive voltage Vr(t), Vc(t) to a connected row or column trace. The drive voltage varies between a high level and a low or reference potential level.

As will be understood from the description below, the potentials applied by row drivers 82 and column drivers 68 are such as to act in a "half select" mode whereby toner cannot pass through an aperture 30 unless both row and column potentials at the aperture 30 intersection are at the high level.

In operation, ASIC 64 first loads column latches 68 with appropriate data signals and then provides enable signals to both a selected row latch in row latches 80 and to column latches 68 to cause a simultaneous readout of drive voltages on respectively connected row and column traces.

As shown in FIG. 1*a*, column traces 36, 38, 40, etc. are positioned on a slant so as to enable improved resolution to be obtained by closer packing of pixel apertures 30. To print a complete line, a plurality of rows of data must be printed in order to obtain the complete pixel row. ASIC 64 synchronizes the print action with the movement of media sheet 26 over platen 24. The means for moving media sheet 26 are not shown, but are well known to those skilled in the art.

Those skilled in the art will understand that negatively charged toner particles 22 will only move towards platen potential Vp if all intervening potentials are at least as high as Vd and, preferably, are more positive in potential. As will be hereafter understood, four states, i.e., A, B, C and D occur as a result of the application of the bias and drive voltages to the printer components. Vd is the bias applied to developer roll surface 20 and Vp is the bias applied to conductive platen 24.

When both a row electrode ring 54 and an intersecting column electrode ring 52 are maintained at a reference potential level (e.g., ground), the negative potential gradient between developer roll surface 20 and column electrode ring 52 prevents migration of negatively charged toner particles 22 (i.e., state A). As a result, toner particles do not pass through aperture 30 and into the area affected by conductive platen voltage Vp. Under such circumstances, printing is inhibited and toner is cleaned from insulating surface 60 of address plate 28.

State B occurs when a row is not selected. Under those conditions, row electrode ring 54 is maintained at the reference potential. However, some other row has likely been selected and column electrode ring 52 has a high data voltage Vc applied thereto as a half select potential for the other row. In this state, toner is attracted to column electrode ring 52 but the negative potential gradient from column electrode ring 52 to row electrode ring 54 repels toner particles 22. Printing is inhibited and toner is cleaned from insulating surface 60 of address plate 28.

In state C, row electrode ring 54 is at a high voltage (the row has been selected) but a low voltage is applied to column electrode ring 52. In this state, toner is repelled by column electrode ring 52 and printing is prevented.

In state D, both row electrode ring 54 and column electrode ring 52 have high voltage applied, indicative that the respective row has been selected and that a high data level has been applied to column electrode ring 52. In this state, some of the toner reaching column electrode ring 52 passes through aperture 30 and is attracted to and deposited on a sheet 26 resting on conductive platen 24. Thus, printing occurs.

With screen electrode 58 biased to a voltage Vs, where:

Vd<Vs<Vr, or Vd<Vs<Vc, (depending on which is closer to the platen, Vc or Vr);

there are two effects:

1) The negatively charged toner passing through a pixel aperture 30 will be pushed to the center of the aperture by the negative potential gradient created by the screen bias Vs. The diameter of the stream of toner passing through the pixel aperture 30 will be smaller with a resulting smaller toner spot on media sheet 26.

2) The electric field strength in the gap between the address plate 28 and the media sheet 26 will be higher since Vs<Vc+Vr, and the distance from the surface of screen electrode 56 to platen 24 is less than the distance from the control electrodes to platen 24. Therefore the toner particles 22 passing through pixel aperture 30 will move more quickly to the surface of media sheet 26.

Figure 3:
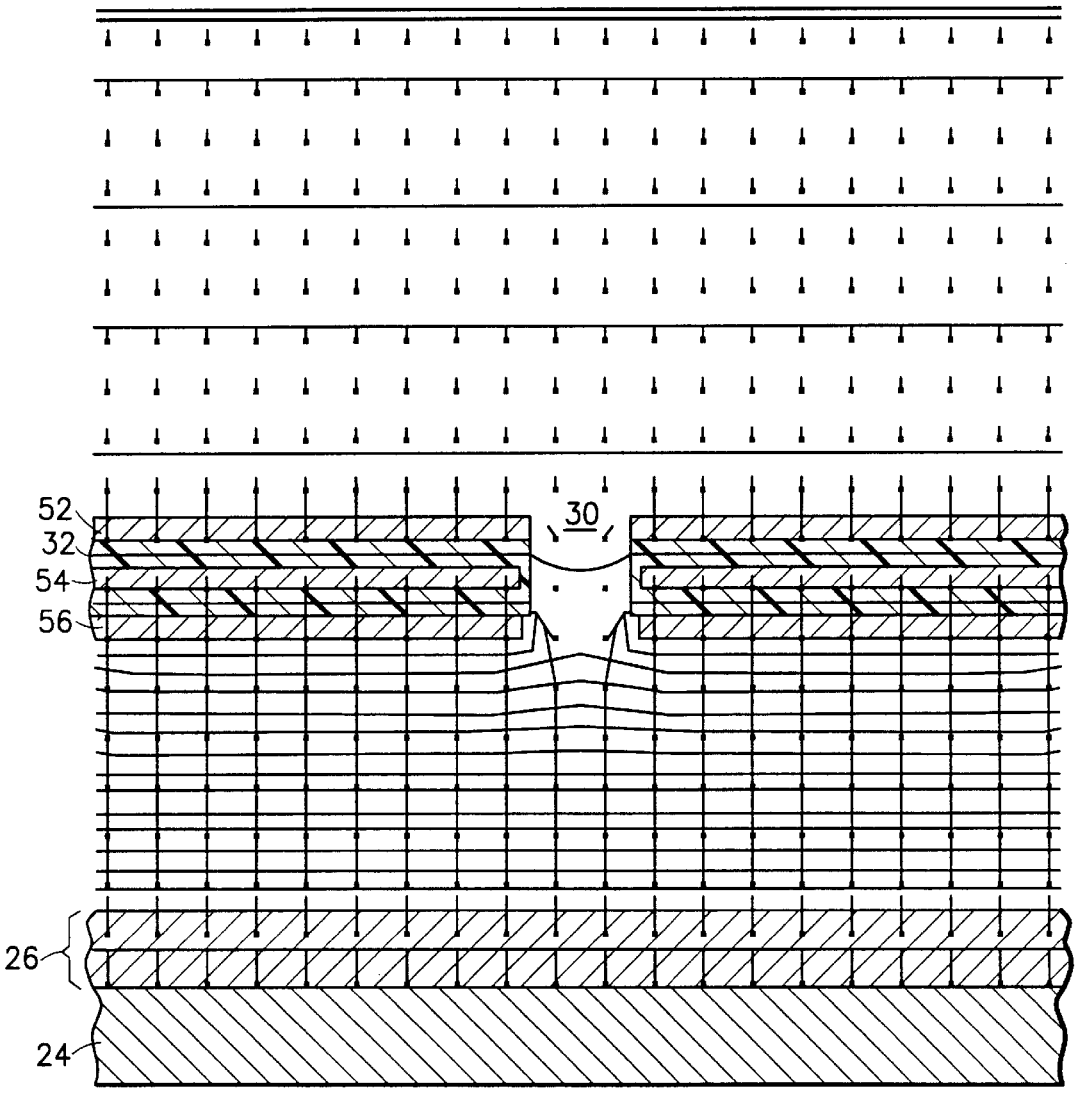
FIG. 3 shows a field plot for the toner projection printer structure of FIG. 1.

FIG. 3 is a field plot of a two dimensional simulation representing a single element of a print array with a screen electrode 56. The approximately horizontal lines are equipotential lines and the short, approximately vertical, lines terminating in a dot indicate the direction and magnitude of the electric field at that point. In this stimulation the following dimensions and potentials were used:

distance from developer 20 to surface of column electrode 52=500 um;

thickness of all electrodes=25 um;

distance from media sheet 26 to surface of screen electrode 56=275 um;

thickness of insulating sheet 32=75 um;

diameter of pixel aperture 30=130 um;

insulating sheet 32 relative dielectric constant=2.2;

media sheet relative dielectric constant=2;

media sheet thickness=100 um;

developer 20 bias, Vd=0 V;

column and row electrode active voltages,(Vc and Vr)=200 V;

platen 24 bias, Vp=800 V screen electrode 56 bias, Vs=160 V.

Figure 4:
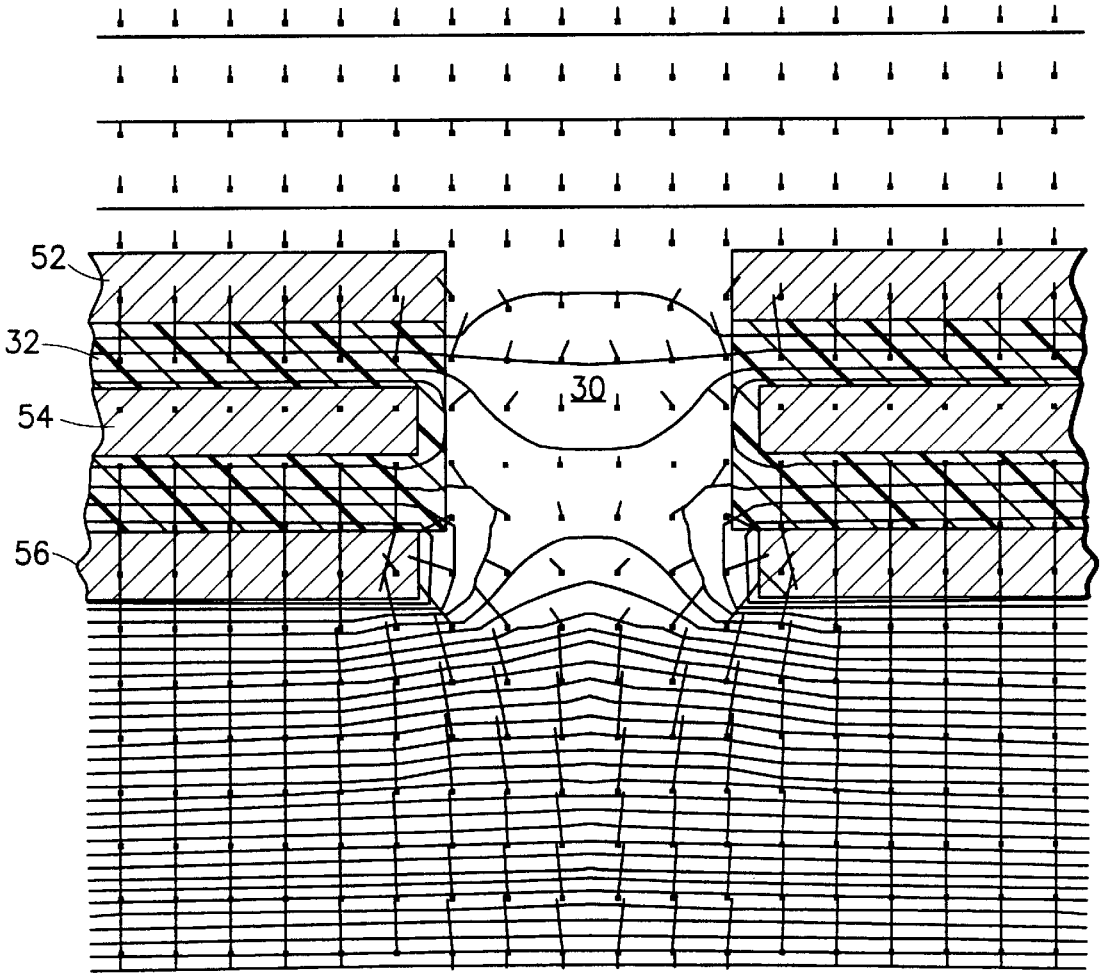
FIG. 4 shows a magnification of the field plot of FIG.3.

FIG. 4 is an expanded view of the two dimensional field plot simulation of FIG. 3. Note that screen electrode 56 significantly affects the field structure at the exit of pixel aperture 30 in a manner to deflect toner particles inwardly towards the aperture center line. Such action serves to partially overcome the like-charge repulsion effects between the toner particles and inhibits toner spreading. As a result, toner dots deposited on media sheet 26 exhibit sharper edge definition.

Further improvements in pixel-edge definition can be accomplished in the toner projection printing process by providing means for modifying the shape of the electric field between array plate 28 and media sheet 26. The improvements described hereinbelow can be used individually or together.

Figure 5A:
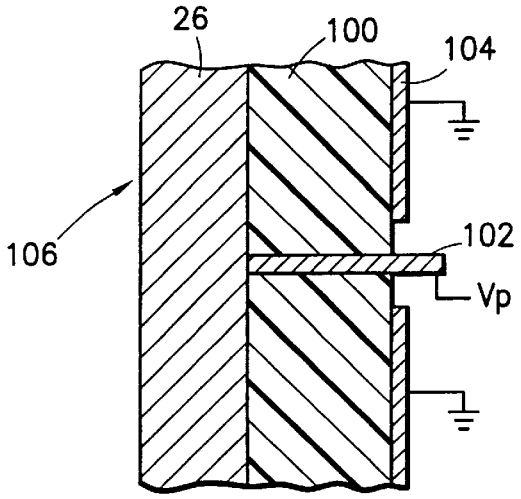
FIG. 5*a* shows a sectional view of an improved platen structure which reduces toner spreading.
Figure 5B:
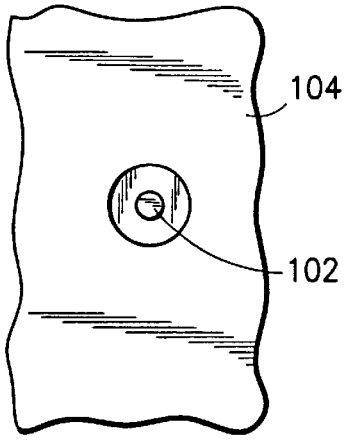
FIG. 5*b* shows a plan view of the lower surface of the platen structure of FIG. 5*a*.

A first improvement (see FIGS. 5*a* and 5*b*) involves a modification of the platen so that rather than being a single conductive surface, it comprises an insulating block 100 with a number of small diameter conductive posts 102 passing through it. One conductive post 102 is positioned beneath every aperture 30 in array plate 28. Insulating block 100 is preferably comprised of a high dielectric strength material, such as Mylar, a trademark of the DuPont Corporation. On the reverse side of insulating block 100, all conductive posts 102 are connected to a high voltage source (Vp). On the reverse side of insulating block 100 is a conductive sheet 104 which includes holes so that the conductive posts 102 can pass through. Conductive sheet 104 is grounded. The effect of conductive sheet 104 is to shape the electrostatic field around conductive posts 102 so that there is an increased horizontal field component at air interface 106 with media sheet 26.

Figure 6A:
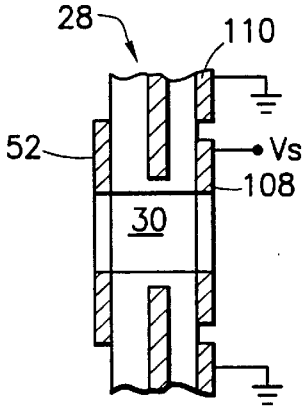
FIG. 6*a* shows a sectional view of an improved address plate structure which reduces toner spreading.
Figure 6B:
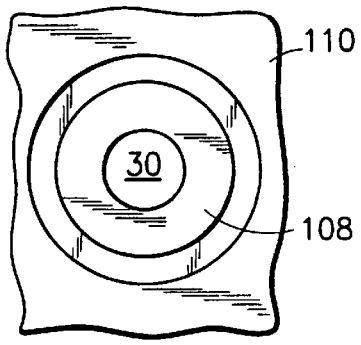
FIG. 6*b* shows a plan view of the lower surface of the improved address plate structure of FIG. 6*a*.

The second improvement (see FIGS. 6*a* and 6*b*) involves a modification of the side of array plate 28 which faces the platen. A conductive ring 108 is placed around every print aperture 30. While this ring may be a row (or column) address element, it is preferred that it be a screen element for modifying the electric field within aperture 30. A voltage Vs (which is positive to attract toner particles) is applied to each conductive ring 108. The remainder of the side of array plate 28 facing the platen is covered with a conductive ground plane 110 which is provided with openings at every print aperture 30 which clear conductive rings 108.

Figure 7:
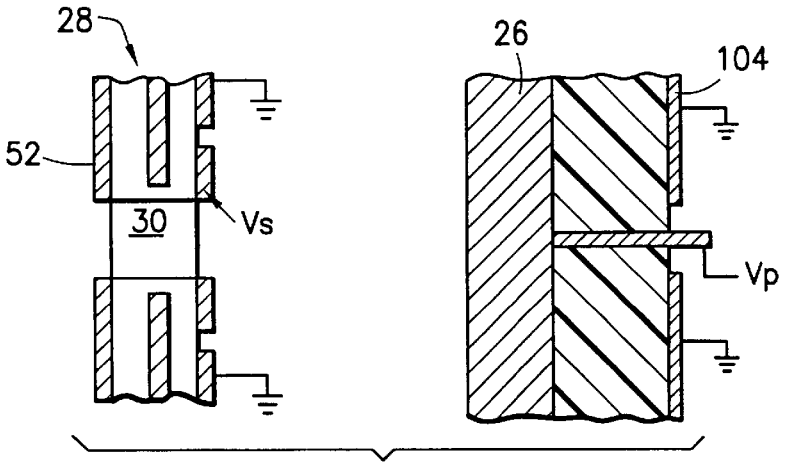
FIG. 7 an assembled sectional view of the platen structure of FIG. 5*a*and the address plate structure of FIG. 6*b*.

FIG. 7 shows an array plate/platen configuration which combines the improvements described above and shown in FIGS. 5*a*, 5*b*, 6*a* and 6*b*.

Figure 8:
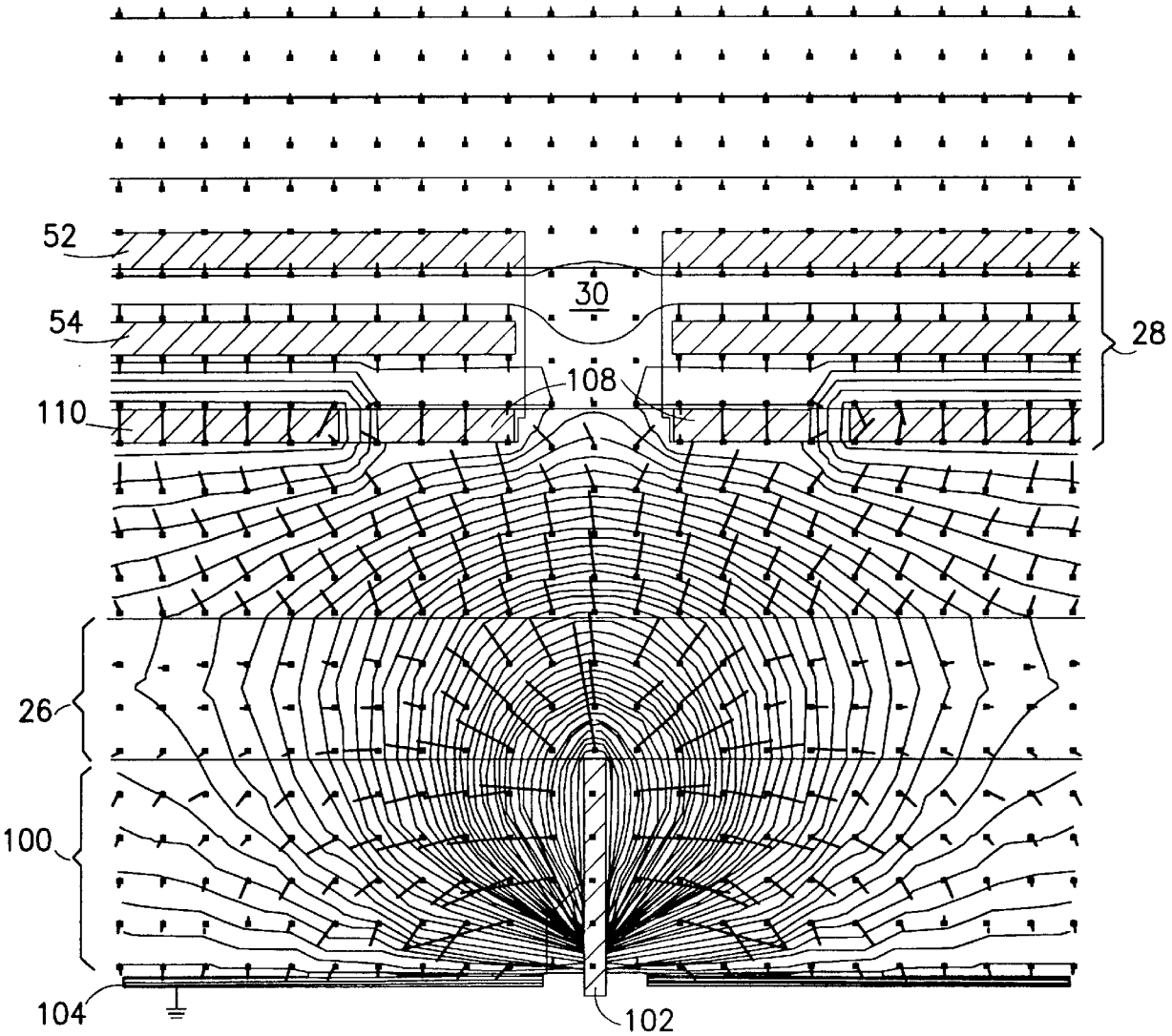
FIG. 8 shows a field plot for the toner projection printer structure of FIG. 7.

FIG. 8 is a two dimensional simulation of the electrostatic fields of the configuration of FIG. 7, with Vp=2000 volts, Vs=160 volts, Vc=160 volts and Vr=250 volts. The shape of the electric field is illustrated by the equipotential lines. The short lines terminating in a dot indicate the direction and magnitude of the electric field at that point. Note that the horizontal component of the electrostatic field at the surface of media sheet 26 is substantially horizontal and facing inwardly towards conductive posts 102. Thus, the force confining a toner dot on the surface of media sheet 26 will be correspondingly great. Note also, that in the gap between media sheet 26 and array plate 28, there is a significant horizontal component of the electric field which points towards the axis of aperture 30. That field component tends to push the toner particles towards the axis. The overall effect is to focus the toner stream and to counter the electrostatic repulsion between the toner particles. This field component also reduces the scatter of particles which rebound after striking media sheet 26.

Figure 9:
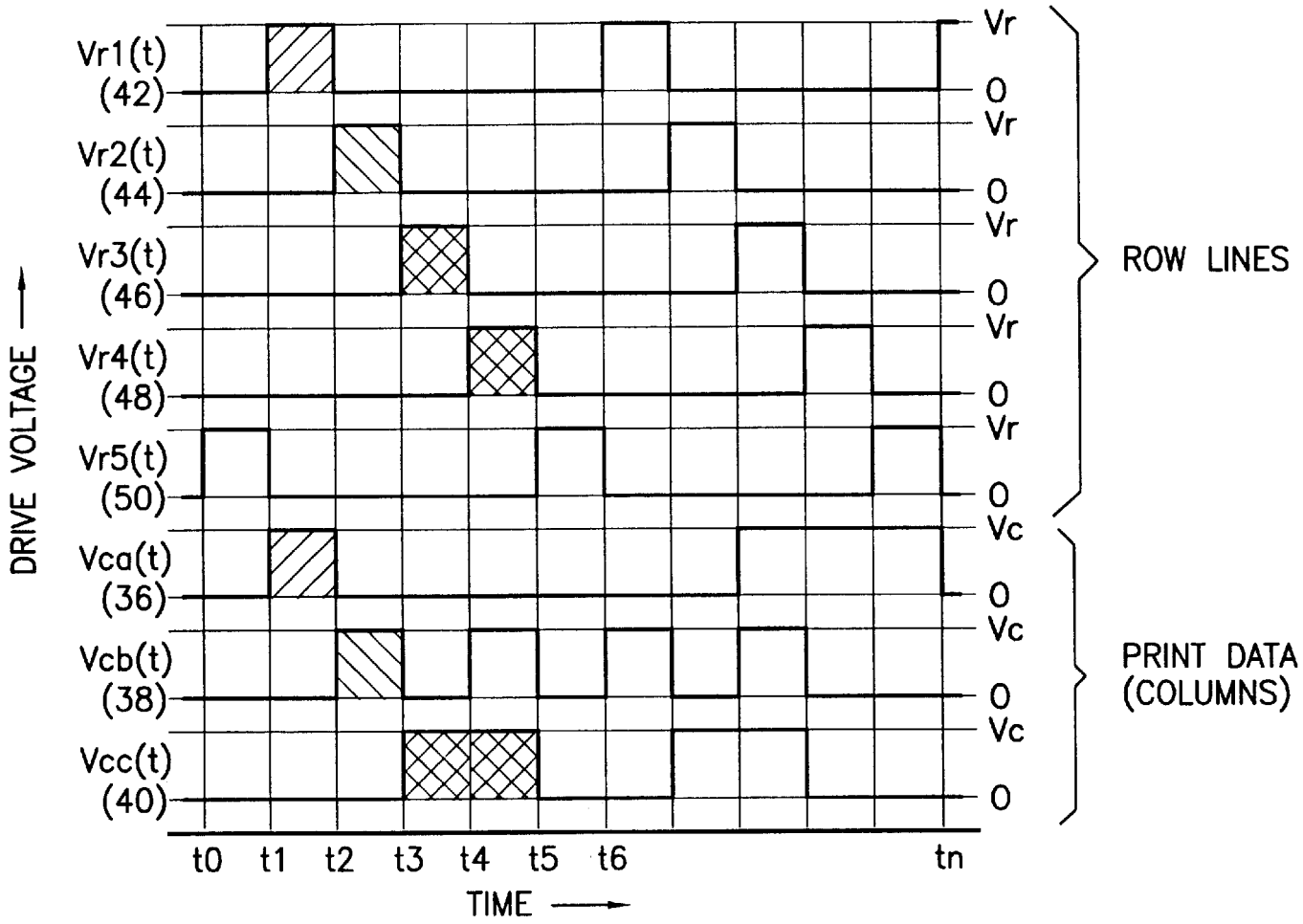
FIG. 9 shows a timing diagram helpful in aiding understanding of the invention.

In FIG. 9, waveforms are plotted which are employed during operation of the invention. Row drive voltages are applied to sequential row traces (e.g. 42, 44, 46, 48, 50, etc.) during succeeding clock periods. Simultaneously with application of a row drive voltage to a row trace, data signals for the particular row are applied on column traces (e.g. 36, 38, 40, etc.). When both the data and column trace drive voltage are at the high level, the printing of a dot occurs at an aperture 30 positioned at the intersection therebetween. Thus, as shown in FIG. 9, the coincident drive voltages applied at time t1 to row trace 42 and column trace 36 cause a dot to be printed at the intersection therebetween (i.e. aperture 30 at pixel position 5 in FIG. 2). Similarly, dots are printed at times t2 and t3 at row/column trace intersections at pixel positions 9 and 13, respectively. Assuming only five row traces are present on address plate 28, the sequencing of row voltages to the row traces repeats at time t6.

It should be understood that the foregoing description is only illustrative of the invention. Various alternatives and modifications can be devised by those skilled in the art without departing from the invention. For instance, the above description has assumed the presence of a media sheet passing beneath address plate 28. By contrast, platen 24 can be made movable so as to directly receive the toner deposits and then to move them to a transfer point where they are removed to a media sheet. Accordingly, the present invention is intended to embrace all such alternatives, modifications and variances which fall within the scope of the appended claims.

What is claimed is:

1. An electrostatic apparatus for applying toner to a sheet, said apparatus comprising:

a developer surface manifesting a voltage bias Vd;

toner particles entrained about said developer surface by charge attraction;

platen means in opposed position to said developer surface and manifesting a voltage bias Vp that exerts an attractive force on said toner particles;

address plate means disposed between said developer surface and said platen means and comprising an insulator sheet having plural apertures therethrough, each of said plural apertures juxtaposed to at least a row conductor and a column conductor, said row conductor and column conductor electrically insulated from each other, said address plate means further having screen electrode means positioned on a surface thereof that is closest to said platen means;

row drive means coupled to said row conductor for controllably applying a row drive voltage which is either at a reference level or a drive level;

column drive means coupled to the column conductor for controllably applying thereto a column drive voltage which is either at a reference level or a drive level, said column drive voltage and row drive voltage manifesting drive levels such that only when both are at their respective drive levels do said toner particles pass through said aperture and are drawn towards said platen means under influence of Vp;

screen bias means for applying a screen bias Vs to said screen electrode means, wherein said screen bias Vs is set to exert a repulsive effect on toner particles that pass through said aperture under influence of said row drive voltage and column drive voltage; and control means for operating said row and column drive means to concurrently output said drive level voltages when toner particles are to pass through said aperture and to further operate at least one of said row drive means and column drive means to manifest a reference voltage if toner particles are to be inhibited from passage through said aperture.

2. The electrostatic apparatus as recited in claim 1 wherein a media sheet is positioned between said platen means and said address plate means and receives said toner particles when said toner particles pass through said aperture.

3. The electrostatic apparatus as recited in claim 1, wherein said platen means is movable so as to enable toner deposited thereon to be moved to a transfer station transferred to a media sheet.

4. The electrostatic apparatus as recited in claim 1, wherein said row conductor and said column conductor each comprise a conductive annulus which surrounds an associated aperture.

5. The electrostatic apparatus as recited in claim 1, wherein said toner particles manifest a negative charge and said screen electrode means comprises a conductive sheet positioned on a surface of said address plate means that is disposed closest to said platen means, said conductive sheet provided with holes aligned with each of said plural apertures, and wherein said screen bias Vs is more negative than a drive level of either said row drive voltage or said column drive voltage.

6. The electrostatic apparatus as recited in claim 1, wherein said platen means comprises a conductive planar sheet.

7. The electrostatic apparatus as recited in claim 1, wherein said platen means comprises an insulating planar sheet having plural conductive posts positioned therein, each of said plural conductive posts aligned with an aperture in said address plate means, each of said plural conductive posts manifesting said platen bias voltage Vp.

8. The electrostatic apparatus as recited in claim 7, wherein said platen means further comprises a rear surface disposed away from said address plate means, said rear surface including a conductive plane connected to a reference potential.

9. The electrostatic apparatus as recited in claim 7, wherein said toner particles manifest a negative charge and said screen electrode means comprises a conductive annulus positioned about each of said plural apertures on a surface of said address plate means that is disposed closest to said platen means, and wherein said screen bias Vs is more negative than a drive level of either said row drive voltage or said column drive voltage and is applied to each said conductive annulus, said surface of said address plate means disposed closest to said platen means further manifesting a conductive layer connected to a source of reference potential, said conductive layer provided with a clearance area about each said conductive post.

10. The electrostatic apparatus as recited in claim 1, wherein said toner particles manifest a negative charge and said screen electrode means comprises a conductive annulus positioned about each of said plural apertures on a surface of said address plate means that is disposed closest to said platen means, and wherein said screen bias Vs is more negative than a drive voltage level and is applied to each said conductive annulus.

* * * * *